US008087541B2

(12) United States Patent
Valota et al.

(10) Patent No.: US 8,087,541 B2
(45) Date of Patent: Jan. 3, 2012

(54) AUTOMATIC PRODUCT VENDING MACHINE

(75) Inventors: Gabriele Valota, Dalmine (IT); Aristide Domenico Roncari, Paderno Dugnano (IT); Sergio Pesenti Barili, Stezzano (IT)

(73) Assignee: N&W Global Vending S.p.A., Valbrembo (IT)

( * ) Notice: Subject to any disclaimer, the term of this patent is extended or adjusted under 35 U.S.C. 154(b) by 233 days.

(21) Appl. No.: 12/444,737

(22) PCT Filed: Sep. 11, 2007

(86) PCT No.: PCT/EP2007/059517

§ 371 (c)(1),
(2), (4) Date: Apr. 8, 2009

(87) PCT Pub. No.: WO2008/043631

PCT Pub. Date: Apr. 17, 2008

(65) Prior Publication Data

US 2010/0032446 A1 Feb. 11, 2010

(30) Foreign Application Priority Data

Oct. 9, 2006 (IT) ..... PN2006A0076

(51) Int. Cl.
*G07F 11/42* (2006.01)

(52) U.S. Cl. ..... 221/301; 221/251; 221/85; 221/175

(58) Field of Classification Search ..... 221/251, 221/301, 289, 125, 85, 175
See application file for complete search history.

(56) References Cited

U.S. PATENT DOCUMENTS

| | | | | |
|---|---|---|---|---|
| 4,108,333 | A * | 8/1978 | Falk et al. | 221/13 |
| 6,073,801 | A * | 6/2000 | McGarrah | 221/298 |
| 6,415,953 | B1 * | 7/2002 | O'Brien et al. | 221/196 |
| 6,966,455 | B2 * | 11/2005 | Skavnak | 221/251 |
| 7,604,145 | B2 * | 10/2009 | Percy | 221/95 |
| 7,686,185 | B2 * | 3/2010 | Zychinski | 221/279 |
| 2004/0188455 | A1 * | 9/2004 | Shioya | 221/123 |

FOREIGN PATENT DOCUMENTS

| | | | |
|---|---|---|---|
| WO | 00/30961 | A1 | 6/2000 |
| WO | 2004/006195 | A2 | 1/2004 |

OTHER PUBLICATIONS

International Search Report: PCT/EP2007/059517.

* cited by examiner

*Primary Examiner* — Patrick Mackey
(74) *Attorney, Agent, or Firm* — Ladas & Parry LLP

(57) ABSTRACT

The present invention relates to an automatic product dispenser, i.e. vending machine featuring improved product delivery ability. The vending machine according to the present invention comprises at least one tray (5) for supporting the products (2) to be dispensed, which is arranged in a substantially horizontal manner and is subdivided into a plurality of compartments (6), at least a conveyor belt (9) for handling the products (2) within said compartments (6) and conveying said products (2) towards a release section (35); the inventive vending machine further comprises delivery means (17) provided close to said release section (35). The inventive vending machine is characterized in that at least one of said compartments (6) is so configured as to be able to receive products (2) arranged along two rows, and in that it comprises selection means (19) adapted to arrange said products (2) into a single row in proximity of said release section (35).

15 Claims, 8 Drawing Sheets

AUTOMATIC PRODUCT VENDING MACHINE

The present invention refers to an automatic product vending machine featuring an improved dispensing ability.

Nowadays, automatic product vending machines commonly in use are provided with an outer casing, or cabinet, within which there are placed a number of substantially horizontal trays on which there are provided a plurality of spiraliform, i.e. helical members. Between their coils, these members accommodate products of the most varied kind, such as snacks, bakery products, packaged products of various kind, cans and tins, bottles, and the like, and are associated to a motor that is adapted to drive them rotatably about their own longitudinal-extension axis. When the vending machine is required to complete the delivery of a product selected by a user, the spiral accommodating such particular product is caused to rotate by the motor, which it is associated to, until the selected product, which is thereby caused to progress towards the front edge of the tray, ultimately falls by gravity into a collecting cavity that is provided to be accessible from the outside of the vending machine.

More recently, vending machines of this kind comprising a plurality of spiraliform members have been used, further to purposes of vending products packaged in bags, boxes and the like, also to dispense beverages filled in bottles, tins and/or cans. However, regardless of the kind of packaging used to contain the products being sold and vended, vending machines of the above-described kind suffer from a rather poor aptitude to contain a relatively large variety and number of products, as well as poor reliability.

In particular, the rather limited reliability of the vending machines of the above-described kind can be ascribed to the really frequent occurrence of product jamming situations, which are generally due to products that, as they come in proximity of the release or dropping section, get stuck between the coils of the spiral and the tray, thereby causing the delivery of the products accommodated in that particular spiral to cease. A second source of poor reliability can be traced back to the fact that an excessive extent of rotation of the spiral unavoidably causes a number of products to be dispensed in excess of the amount corresponding to the sum of money introduced by the user in the vending machine.

In view of enhancing the reliability of prior-art vending machines of the above-described kind, a number of solutions have been proposed, such as for instance the use of complicated arrangements for controlling the rotation of the spirals, as well as appropriately sized spirals aimed at reducing the causes of product jamming. These solutions, however, have turned out as being scarcely effective and hardly adaptable in the case that the vending machine is required to dispense products of various nature and/or contained in widely varying packages as far as shapes and sizes are concerned.

As already mentioned above, a further drawback of vending machines of the kind comprising a plurality of spiraliform members lies in the reduced number of products that can be accommodated between the coils of each spiraliform member and, as a result, on the entire surface of each tray. The presence of the spirals themselves, along with the related actuation or driving devices thereof, is such as to reduce the space that remains available for the storage of the products inside the outer casing of the vending machine, thereby reducing the sale opportunities for the vending service operator, while at the same time increasing the number of serviceman's hours required to refill the machine by replacing sold products with new ones. In other words, this involves a considerable use of both human and economic resources that should desirably be reduced.

Although vending machines have been in the meanwhile proposed, in which the spiraliform members have been replaced with small-size conveyor belts that are capable of receiving and accommodating packaged products arranged on a single row, the product storage capacity of such machines has practically not been increased to any appreciable extent.

It is therefore an object of the present invention to provide an automatic product vending machine that does away with the drawbacks and disadvantages of prior-art vending machines.

Within this general object, it is a purpose of the present invention to provide an automatic product vending machine having an improved reliability and capable of enabling a larger number of products to be stored there as compared with prior-art machines, thereby enabling the available product storage space to be optimized.

It is a further purpose of the present invention to provide product dispensing means that take up as small a space as possible.

Yet another purpose of the present invention is to provide an automatic product vending machine that is able to dispense a wide variety of products, differing from each other as far as both type and size are concerned, with an excellent record of both efficiency and reliability, the same vending machine being at the same time free of product jamming occurrences and product dispensing failures whatsoever, thereby doing away with undesired machine downtime problems due to maintenance and repair problems.

A further, equally important purpose of the present invention is to provide an automatic product vending machine that is capable of being manufactured and assembled in a most simple manner.

According to the present invention, these aims, along with further ones that will become apparent from the following disclosure, are reached in an automatic product vending machine that incorporates the features and characteristics as recited in claim 1 appended hereto.

Further features and advantages of the present invention will anyway be readily understood from the description that is given below by way of non-limiting example with reference to the accompanying drawings, in which.

Figure 1:
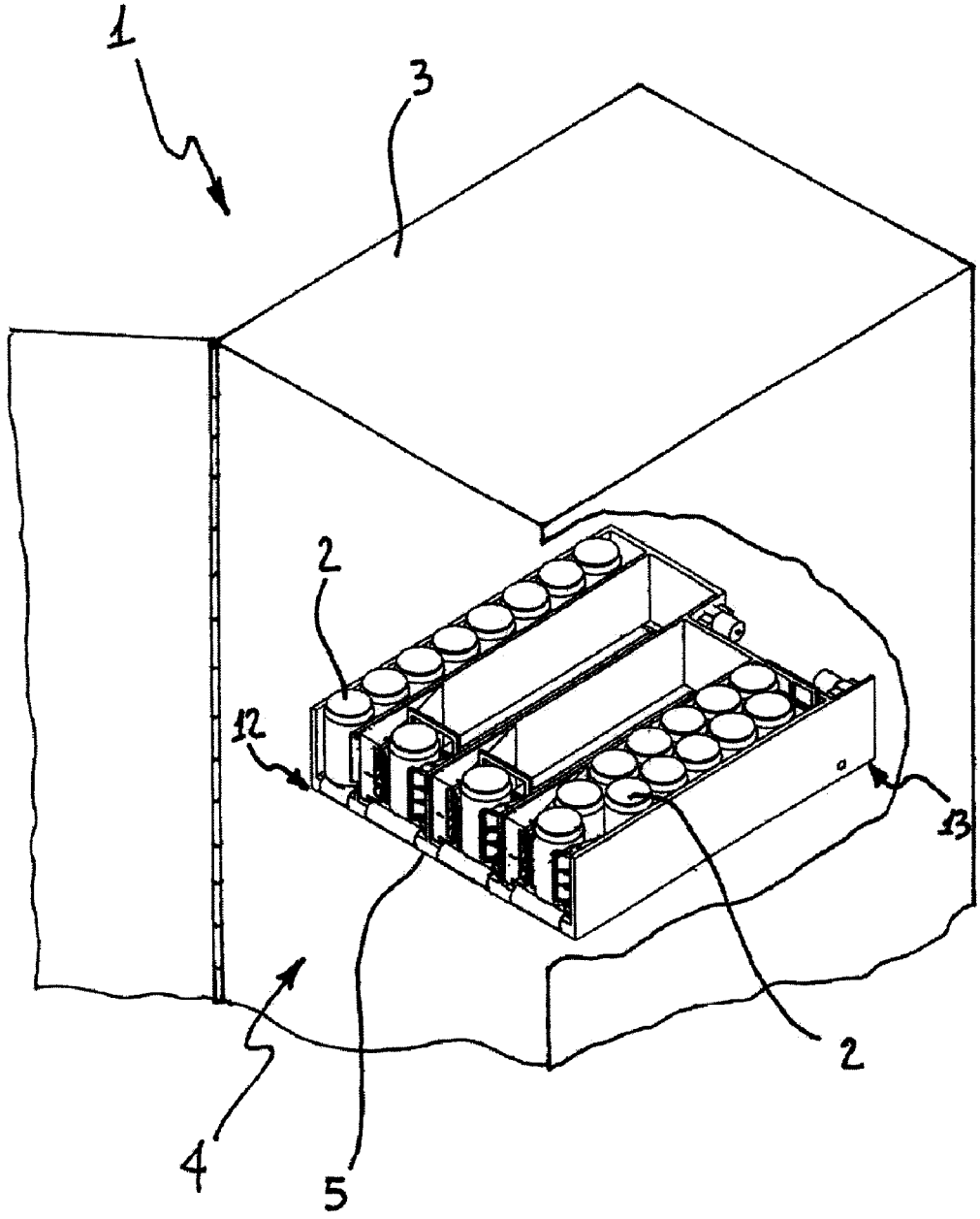
FIG. 1 is a schematic perspective view of a product vending machine according to the present invention.

FIG. 1 illustrates an automatic vending machine 1 comprising an outer casing 3, which defines a cavity 4 for one or more trays 5 (only one tray is shown in FIG. 1 for reasons of greater illustrative simplicity) to be accommodated therewithin. The trays 5 are arranged in a substantially horizontal manner and support a plurality of products 2, which may consist of product packages of various kinds, such as for instance tins, cans, bottles, and the like.

Figure 2:
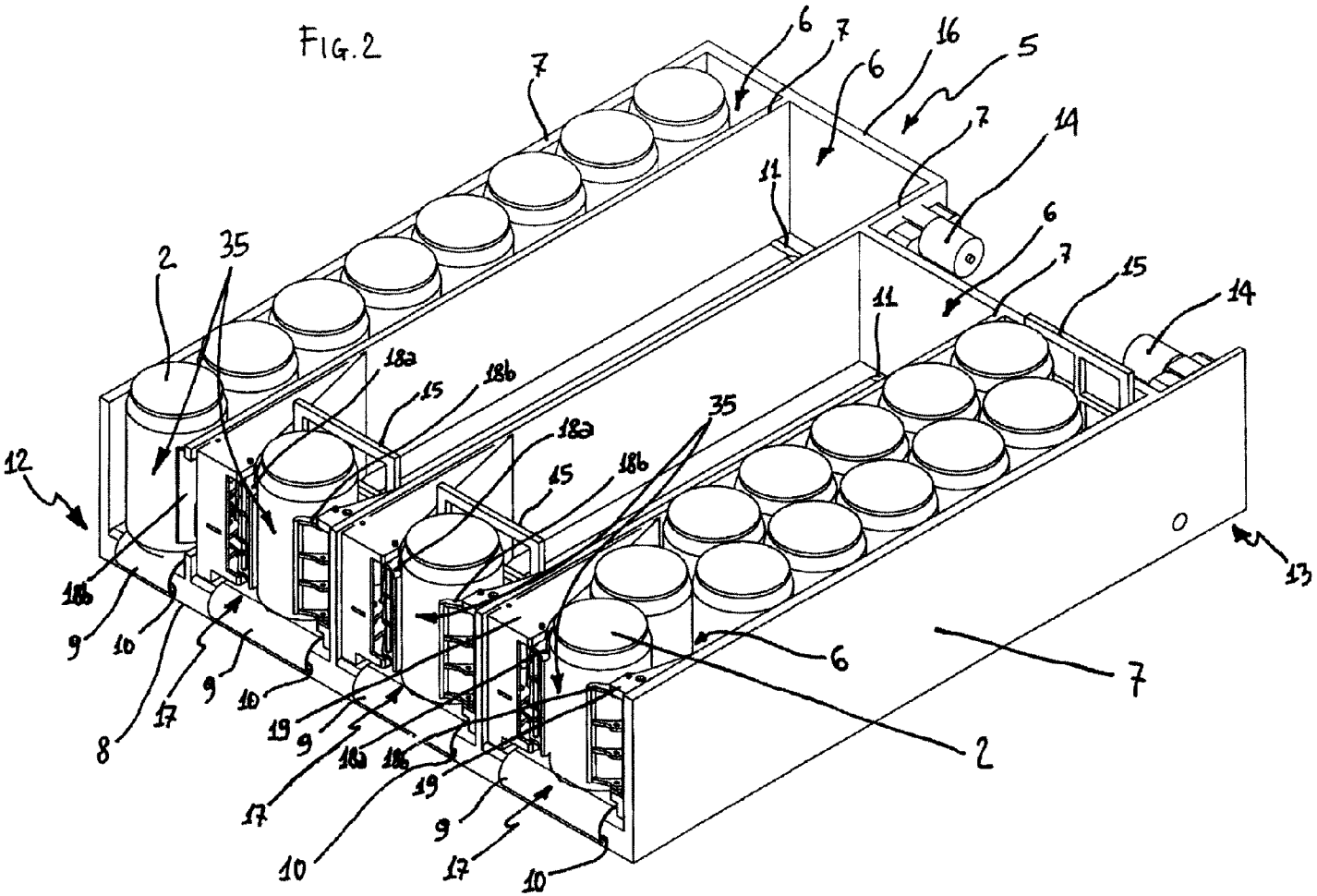
FIG. 2 is a perspective view of a product storage tray.

In FIG. 2 there is illustrated a tray 5 that defines a substantially horizontal plane, on which there are placed and resting a plurality of products 2 in the form of cans. The tray 5 is subdivided into a plurality of compartments 6 defined by partitions 7 extending parallel to each other and arranged orthogonally to the plane 8. Each such compartment 6 is equipped with a conveyor belt 9 mounted and running on rollers 10 and 11, which are located at a front portion 12 and a rear portion 13 of the tray 5, respectively, and extend in a crosswise direction relative to the partitions 7. Each such conveyor belt 9 carries the products 2 and is driven by motor means 14 so that, when a user requires a product to be dispensed, the same products 2 are carried forwards by the conveyor belt 9 towards a release section 35, which is preferably located at the front portion 12 of the tray 5. In order to facilitate the conveyance of such products 2 towards said release section 35, each compartment 6 is provided with a backing member 15—of a type as is generally known as such in the art—adapted to prevent the same products 2 from capsizing. Each such backing member 15 is associated to an elastically biasing member (not shown in FIG. 2) that enables it to remain constantly in contact with the products 2 lying closest to the rear portion 13 of the tray 5, i.e. the rear wall 16 of the latter. The conveyor belt 9 can move forward freely without necessarily displacing the backing member 15.

In view of optimizing the availability of free space on the surface 8 of the tray 5, one or more of the above-mentioned compartments 6 are configured so as to be able to receive and accommodate products 2 as lined up into two parallel rows running in a side-by-side arrangement. For the products 2 to be then able to be dispensed from the release section 35 of the tray 5, i.e. the front portion 12 of the tray 5 as shown in FIG. 2, each compartment 6 is further provided with delivery means 17 that comprise a pair of jaws 18*a*, 18*b*. In particular, the jaws 18*a*, 18*b* are located at an extremity portion of the partitions 7 defining the compartment 6, i.e. in proximity of the release section 35 at which the products 2 leave the tray 5 to freely drop by gravity therefrom.

The compartments 6 of a type generally known as such in the art, which are configured to accommodate the products 2 arranged in succession one after another to form a single row, require the use of just a single jaw.

Figure 3:
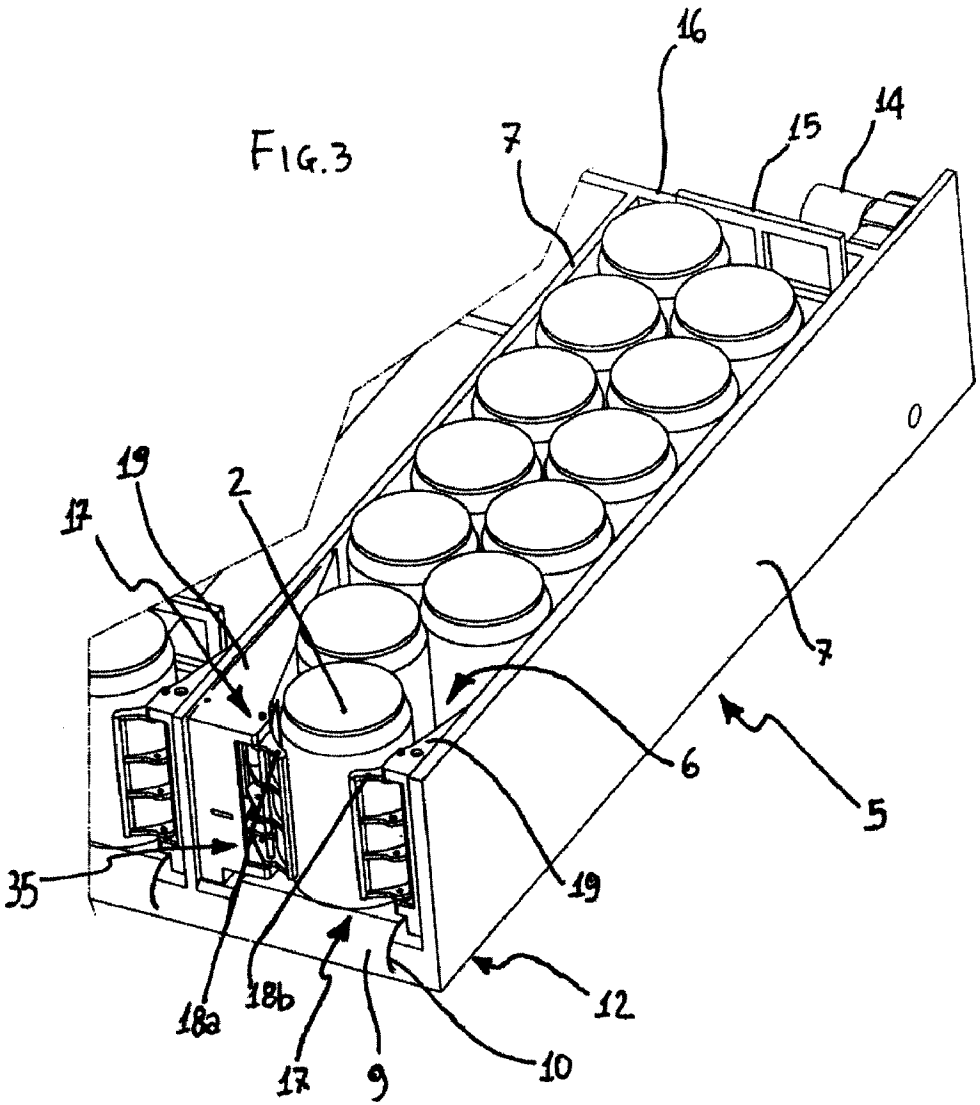
FIG. 3 is a perspective view of the product storage tray of FIG. 2, as viewed in a first phase of the process in which a product is being dispensed from the same tray.
Figure 4:
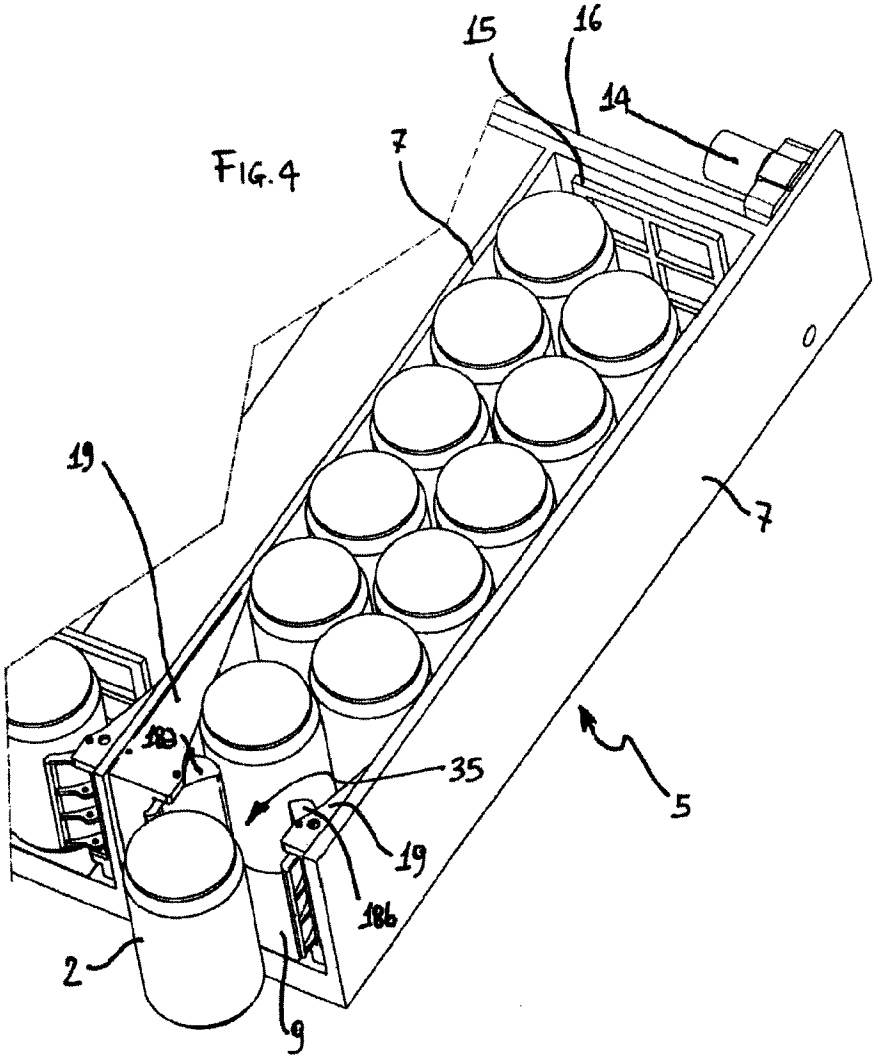
FIG. 4 is a perspective view of the product storage tray of FIG. 2, as viewed in a second phase of the process in which a product is being dispensed from the same tray.

FIG. 3 illustrates a first phase in the process of dispensing one of the products 2 that are accommodated in a compartment 6 in an arrangement formed by two side-by-side, parallel rows. When a user inserts an adequate sum of money in the machine as required to buy a product 2, and upon selecting one of the compartments 6 holding the desired product, the motor means 14 are actuated for them to rotatably drive the rollers 10 and 11 that move the conveyor belt 9, thereby causing all the products 2 lying thereupon to move forwards in the direction of the delivery means 17. In view of then reducing the number of the rows of products 2 from two to just a single one, there are provided selection means 19 that substantially cause the width of the compartment 6 to be gradually narrowed in proximity of the release section 35. To this purpose, the selection means 19 are formed in a wedge-like shape and are provided on the two mutually facing partitions 7 that define the compartment 6. While the products 2 are caused to move forwards by the conveyor belt 9, the jaws 18*a*, 18*b* are in the closed state thereof, in which they in fact prevent the product 2 lying at the front, i.e. in the most advanced position, from falling off the tray 5. Upon allowing a certain period of time to elapse, as measured starting from the moment at which the motor means 14 are actuated and pre-determined so as to make sure that the forwardmost product 2 has reliably come into contact with the jaws 18*a*, 18*b*, the same jaws are actuated by actuation means 20, 220—shown in FIGS. 5 to 8—in such manner that the sole product 2 lying in said forwardmost position is allowed to fall off the tray 5. The product-release state of the jaws 18*a*, 18*b* and a product 2 in the incipient dropping phase thereof, i.e. as it begins to fall off the tray, are illustrated in FIG. 4. As the jaws 18*a*, 18*b* are being actuated, the motor means 14 keep causing the conveyor belt 9 to move forwards. The products 2 coming next to the one that is leaving the tray 5 are retained by the same jaws 18*a*, 18*b* by virtue of the particular manner in which they are configured, as this shall be described in greater detail further on. In this connection, it will most obviously be appreciated that, during the time periods in which the products 2 coming next to the one being dispensed are retained by the jaws 18*a*, 18*b* and the conveyor belt 9 keeps moving forwards, the same conveyor belt will slide under said products 2 without causing them to move forwards any more. This is necessary in view of ensuring that a single product is allowed to drop and that this dropping process takes really place, actually.

Figure 5:
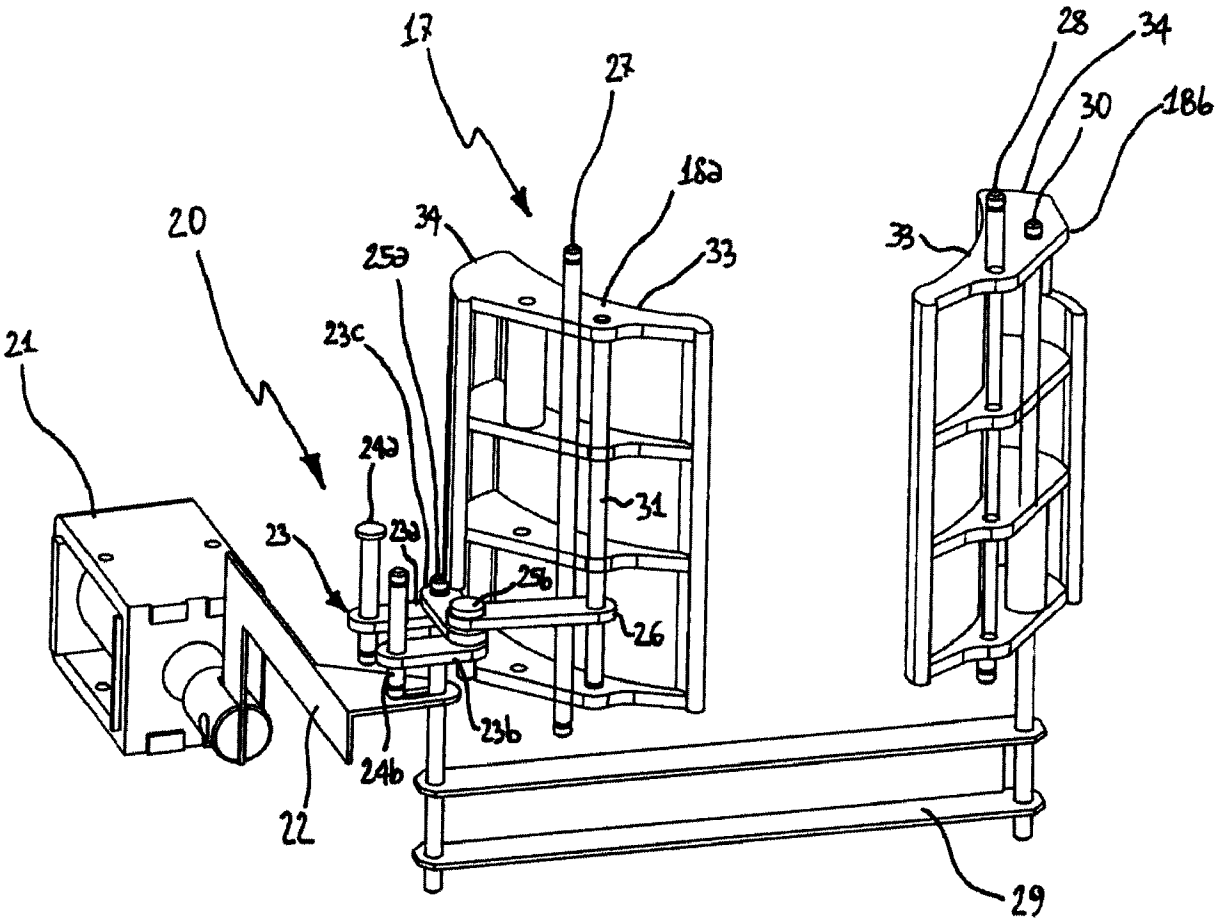
FIG. 5 is a perspective view of a first embodiment of the jaw actuation means.
Figure 7:
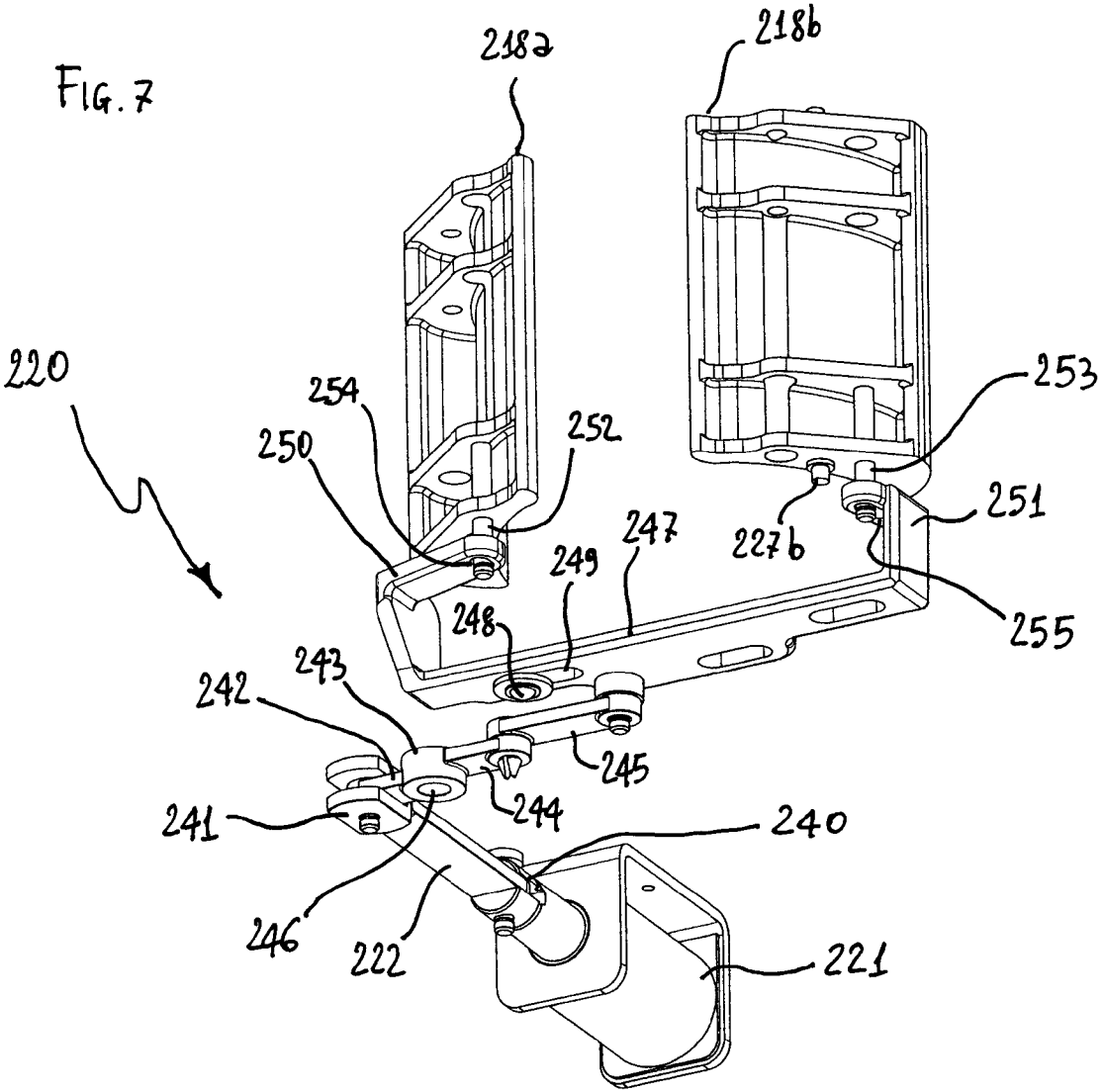
FIG. 7 is a perspective view of a second embodiment of the jaw actuation means with jaws in a closed position.

As a product has then been dispensed in this way, the jaws 18*a*, 18*b* are restored into the closed state thereof by the related actuation means 20, 220 (FIGS. 5 and 7). At this point, the products 2 following the one that has in this way left the tray 5 are free to move forwards again, as carried by the conveyor belt 9, until a new product 2 is brought into contact with the jaws 18*a*, 18*b*. The time needed to complete all of the above-described operations, i.e. the overall operation time of the motor means 14 may vary from 5 to 15 seconds.

In FIG. 5 it is shown a first embodiment of actuation means 20 of the jaws 18*a*, 18*b*. These actuation means 20 comprise an electromagnet 21 causing a rod 22 to move translatorily, To such rod 22 there is associated a four-bar linkage 23 formed of two arms 23*a*, 23*b* having each a first end portion pivotally mounted to the structure of the tray 5 by means of the pins 24*a* and 24*b*, respectively, while the second end portions thereof are pivotally connected with each other by means of a further arm 23*c* and further pins 25*a* and 25*b*. The rod 22 acts upon the pin 25*a*, whereas on the pin 25*b* there is pivotally mounted a connecting rod 26. The latter is associated to the jaw 18*a* by means of a pin 31, and said jaw 18*a* is in turn pivotally mounted to the tray 5 (not shown in FIG. 5) via the pin 27. Also the jaw 18*b* is pivotally mounted to the tray 5 via the pin 28 and is actuated in a synchronized manner with the jaw 18*a* by means of a tappet rod 29 having a first end portion pivotally associated to the pin 25*a* of the four-bar linkage 23 and a second end portion pivotally associated to a pin 30 that is in turn associated to the jaw 18*b*.

Figure 6:
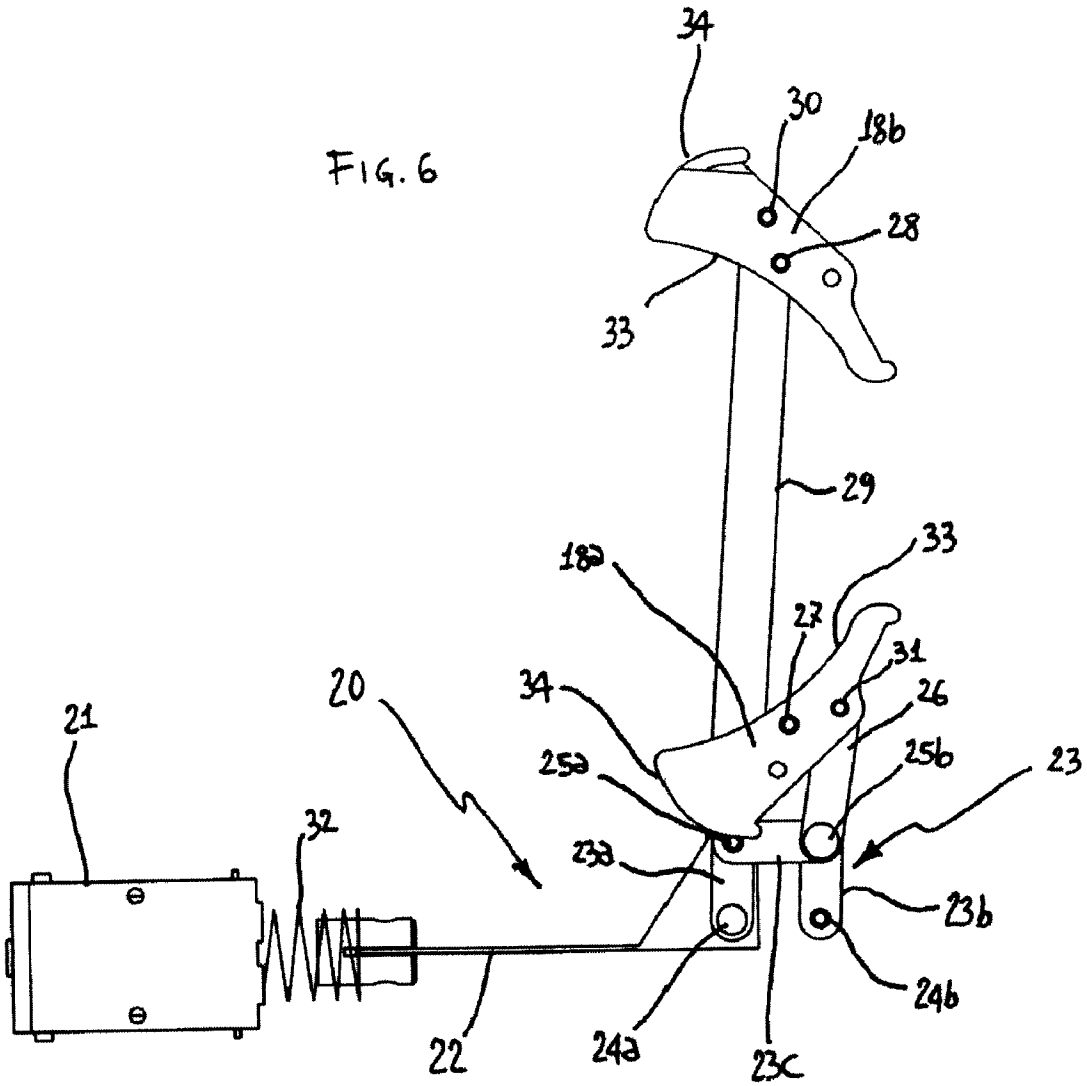
FIG. 6 is a plan view of both the actuation means shown in FIG. 5 and the jaws.

With reference now to FIG. 6, the jaws 18*a*, 18*b* are actuated into opening by the energization of the electromagnet 21, which, when so energized, pulls the rod 22 towards itself by overcoming the resistance of a spring 32. The four-bar linkage 23 leans towards the electromagnet 21, thereby causing both the connecting rod 26 and the tappet rod 29 to follow the same movement. This combined movement causes in turn the jaws 18*a*, 18*b* to rotate about the pins 27 and 28, respectively. When the electromagnet 21 is then de-energized, the spring 32 is allowed to relieve and extend again, thereby moving the rod 22 away from the electromagnet 21. This displacement causes the four-bar linkage 23 to resume the position illustrated in FIG. 6, while the jaws 18*a*, 18*b* move back into the closed state thereof.

The jaws 18*a*, 18*b* comprise a cavity 33, which is so shaped as to be able to receive and accommodate a portion of a product 2 which is ready for being dispensed. In a position adjacent to said cavity 33, each jaw 18*a*, 18*b* comprises an abutment or retaining surface 34 that moves into the compartment 6 to at least partially obstruct it when the jaws 18*a*, 18*b*, owing to them rotating about the axis 27, 28, respectively, open up to allow a product 2 to be released.

Turning now to FIG. 7, it is shown a second embodiment of the actuation means 220 which drive jaws 218*a*, 218*b* to move between a closed and an open position. Actuations means 220 comprise an electromagnet 221 imparting a translatorily movement to a rod 222. At a first end portion 240, such rod 222 is rotatably associated to the electromagnet 221, such that the rod 222 can also rotate when the latter is activated. Rod 222 has a second end portion 241 rotatably associated to a first arm 242 of a rocker 243. Said rocker 243 is hingedly connected to a tray 5 carrying products to be dispensed (not shown in FIG. 7) in a fulcrum 246, and it has a second arm 244 pivotally associated to a lever 245. Lever 245 is, in turn, rotatably associated to a sliding member 247 slidably associated to said tray 5 by means of a pin 248 resting in a slot 249 provided in said member 247.

Sliding member 247 is provided with two wing portions 250, 251 on which jaws 218*a* and 218*b* are rotatably mounted. In particular, jaws 218*a* and 218*b* are associated to wing portions 250, 251 by means of pins 252, 253, each resting in a slot 254, 255.

Jaws 218*a*, 218*b* are also pivotally mounted to the tray 5 (not shown in FIG. 7) via pins 227*a* (see FIG. 8) and 227*b* respectively.

In FIG. 7, jaws 218*a*, 218*b* are shown in a closed position in which they prevent a product 2 (not shown in FIG. 7) from falling off the tray 5. In this position pin 248 is placed at a first end of slot 249.

Figure 8:
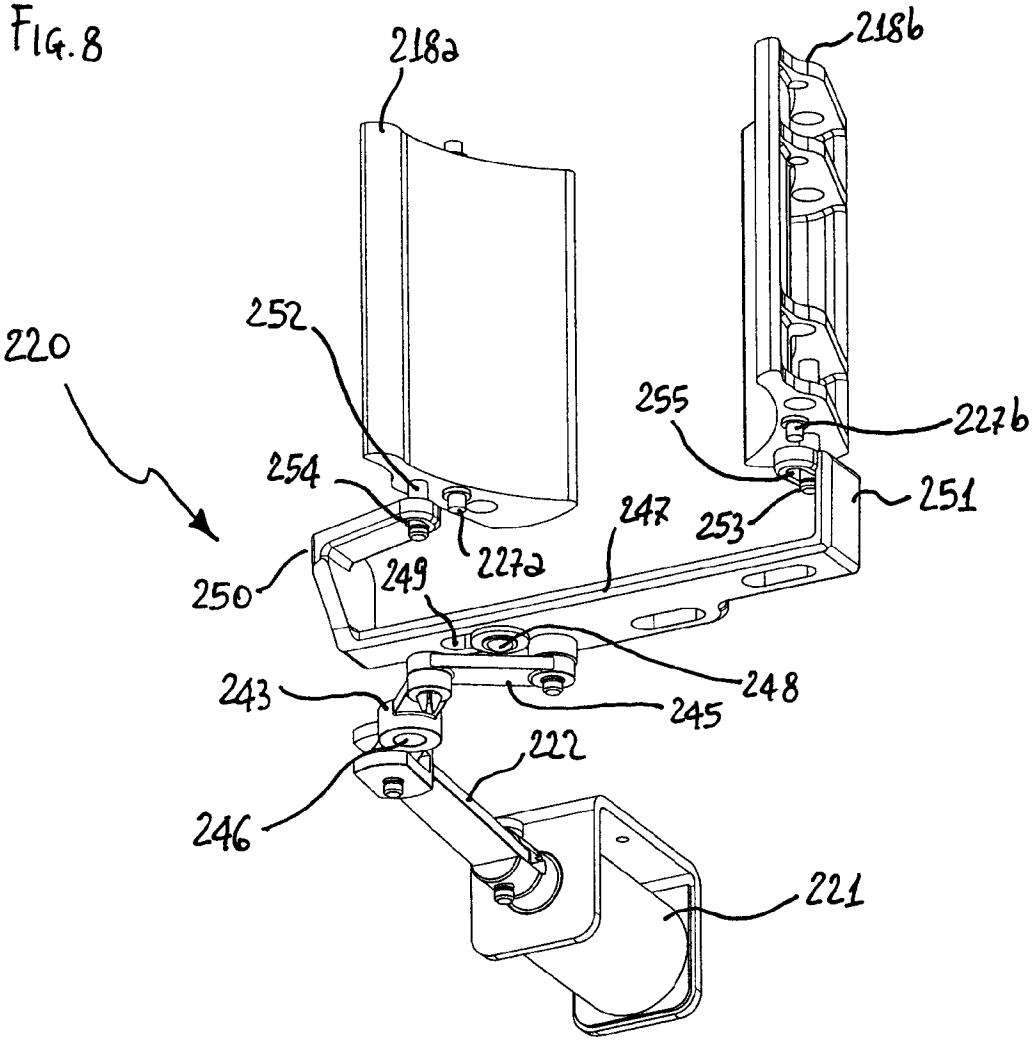
FIG. 8 is a perspective view of the jaw actuation means of FIG. 7 with jaws in an open position.

Referring now to FIG. 8, jaws 218*a*, 218*b* are actuated into opening by the energization of the electromagnet 221, which, when so energized, pulls the rod 222 towards itself by overcoming the resistance of a spring not shown in FIG. 8 but displaced in the same manner described with reference to spring 32 in FIG. 6. Rocker 243 is caused to turn about its fulcrum 246 and such rotation imparts a translational movement to the sliding member 247, via the lever 245 that rotates in an opposite direction with respect to the rocker 243. Thanks to the rocker 243—lever 245 mechanism, said translational movement brings a second end of the slot 249 to engage pin 248, and causes the jaws 218*a*, 218*b* to rotate about pins 227*a*, 227*b* thereby allowing a product resting on a tray 5 to be dispensed by falling off the tray 5.

Jaws 218*a*, 218*b* shown in FIGS. 7 and 8 have the same geometrical and functional characteristics described with reference to FIGS. 5 and 6.

Fully apparent from the above description is therefore the ability of the present invention to effectively reach the aims and advantages cited afore, through the provision of an automatic product vending machine affording a considerable extent of reliability, i.e. capable of ensuring products to be most correctly and reliably dispensed on demand, while avoiding undesired jamming occurrences or the delivery of products in excess of the amount required by the user, i.e. of the sum of money inserted to buy a desired product. In this way, the vending machine according to the present invention does effectively away with the risk for those who run the vending service to suffer economic losses owing to failed sale opportunities or the delivery of products that have not been paid for. Fully apparent is also the ability of an automatic product vending machine according to the present invention to allow the product storage capacity inside the machine to be considerably enhanced and, as a result, the management of the available space within the outer casing of the vending machine to be advantageously optimized.

It shall be appreciated that the materials used, as well as the shape and the sizing of the various parts, may each time be selected so as to more appropriately meet the particular requirements or suit the particular application.

It shall further be appreciated that the various parts forming the object of the present invention shall certainly not be solely embodied in the manner that has been described and illustrated hereinbefore, but can rather be implemented in many other embodiments—although not specifically illustrated here—without departing from the scope of the present invention.

The invention claimed is:

1. An automatic product vending machine comprising:

at least one tray for carrying products to be dispensed, which is arranged in a substantially horizontal manner and is subdivided into a plurality of compartments;

at least one conveyor belt for handling the products within said compartments and conveying said products towards a release section;

delivery means provided close to said release section and comprising a pair of jaws that are rotatably associated to the tray; and actuation means to actuate the jaws in a synchronized manner from a closed state, in which the jaws prevent a product from being released, to a release state, in which the jaws allow said product to be released;

wherein said actuation means comprising an electromagnet and a four-bar linkage, and at least one of said compartments being so configured as to be able to receive products arranged along two parallel rows, and comprising selection means adapted to arrange said products into a single row in proximity of said release section.

2. An automatic product vending machine according to claim 1, wherein said compartments are defined by partitions extending parallel to each other and arranged orthogonally to a plane defining the resting surface for the products; and the selection means being provided on the partitions.

3. Automatic product vending machine according to claim 1, wherein said selection means are configured in a wedge shape.

4. An automatic product vending machine according to claim 1, wherein said jaws comprise a cavity and a retaining surface.

5. An automatic product vending machine according to claim 4, wherein said retaining surface moves into a compartment when the jaws open to allow a product to be released.

6. An automatic product vending machine comprising:

at least one tray for carrying products to be dispensed which is arranged in a substantially horizontal manner and is subdivided into a plurality of compartments;

at least a conveyor belt for handling the products within said compartments and conveying said products towards a release section; and delivery means provided close to said release section and comprising a pair of jaws that are rotatably associated to the tray and are actuated in a synchronized manner by actuation means from a closed state, in which they prevent a product from being released, to a release state, in which they allow said product to be released;

said actuation means comprising an electromagnet and a rocker-lever mechanism, and at least one of said compartments being so configured as to be able to receive products arranged along two parallel rows, and comprising selection means adapted to arrange said products into a single row in proximity of said release section.

7. An automatic product vending machine according to claim 6, wherein said compartments are defined by partitions extending parallel to each other and arranged orthogonally to a plane defining a resting surface for the products; and the selection means being provided on the partitions.

8. An automatic product vending machine according to claim 6, wherein said selection means are configured in a wedge shape.

9. An automatic product vending machine according to claim 6, wherein said jaws comprise a cavity and a retaining surface.

10. An automatic product vending machine according to claim 9, wherein said retaining surface moves into the compartment when the jaws open up to allow a product to be released.

11. An automatic product vending machine comprising:

at least one horizontal tray for carrying products to be dispensed, the tray having a release end-section and a plurality of partitions extending parallel to each other, arranged orthogonally to a plane defining a resting surface for the products and subdividing the tray into a plurality of compartments extending up to the release end-section to allow the products to leave the tray by freely dropping by gravity therefrom, at least one of said compartments being a two-row compartment designed to receive products arranged along two parallel rows;

delivery means provided on the tray at each compartment close to said release end-section;

at least a conveyor belt for handling the products within each compartment, including the two-row compartment, and conveying the products towards and through the release end-section;

said delivery means comprising a pair of jaws that are rotatably associated to the tray; actuation means for actuating said pair of jaws in a synchronized manner from a closed state, in which the jaws prevent a product from being released, to a release state, in which jaws allow said product to be released;

and selection means being provided at said two-row compartment to arrange the products into a single row in proximity of the release end-section; the selection means being formed in a wedge shape and being provided above the conveyor belt and on the two mutually facing partitions that define the two-row compartment.

12. The automatic product vending machine according to claim 11, wherein said actuation means comprise an electromagnet and a four-bar linkage.

13. The automatic product vending machine according to claim 11, wherein said actuation means comprise an electromagnet and a rocker-lever mechanism.

14. The automatic product vending machine according to claim 11, wherein said jaws comprise a cavity and a retaining surface.

15. The automatic product vending machine according to claim 14, wherein said retaining surface moves into the compartment when the jaws open up to allow a product to be released.

* * * * *